US011521451B2

(12) United States Patent
Feulner et al.

(10) Patent No.: US 11,521,451 B2
(45) Date of Patent: Dec. 6, 2022

(54) METHOD AND APPARATUS FOR DETECTING A SECURITY THREAD IN A VALUE DOCUMENT

(71) Applicant: Gieseck+Devrient Currency Technology GmbH, Munich (DE)

(72) Inventors: Johannes Feulner, Munich (DE); Steffen Schmalz, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 582 days.

(21) Appl. No.: 16/473,906

(22) PCT Filed: Dec. 22, 2017

(86) PCT No.: PCT/EP2017/001445
§ 371 (c)(1),
(2) Date: Jun. 26, 2019

(87) PCT Pub. No.: WO2018/121882
PCT Pub. Date: Jul. 5, 2018

(65) Prior Publication Data

US 2019/0347889 A1 Nov. 14, 2019

(30) Foreign Application Priority Data

Dec. 27, 2016 (DE) ..... 102016015559.0

(51) Int. Cl.
*G07D 7/04* (2016.01)
*G07D 7/004* (2016.01)

(52) U.S. Cl.
CPC ..... *G07D 7/04* (2013.01); *G07D 7/004* (2013.01); *G07D 2207/00* (2013.01)

(58) Field of Classification Search
CPC ..... G07D 7/00; G07D 7/003–005; G07D 7/0043; G07D 7/0047; G07D 7/0056;
(Continued)

(56) References Cited

U.S. PATENT DOCUMENTS 6,229,306 B1 5/2001 Stein et al.
8,387,879 B2 3/2013 Schutzmann et al.
(Continued)

FOREIGN PATENT DOCUMENTS

CN 103827929 A 5/2014
DE 19625224 A1 1/1998
(Continued)

OTHER PUBLICATIONS

Office Action from corresponding Chinese Application No. 201780074853.1, Nov. 3, 2020.
(Continued)

*Primary Examiner* — Thien M Le
*Assistant Examiner* — April A Taylor
(74) *Attorney, Agent, or Firm* — Workman Nydegger

(57) ABSTRACT

A method is provided for detecting a security thread in a value document, in which magnetic data are employed for sites on the value document. The magnetic data represents a magnetic property of the value document at the site, check sites on the value document are determined employing the sites, and from the check sites, a straight line is specified, along or on which at least some of the check sites lie and which represents a location of the security thread.

21 Claims, 4 Drawing Sheets

(58) Field of Classification Search
CPC .. G07D 7/01; G07D 7/04; G07D 7/06; G07D 7/08; G07D 7/12; G07D 7/17; G07D 7/1205; G07D 7/121; G07D 7/128; G07D 7/164; G07D 7/181; G07D 7/182; G07D 7/187; G07D 7/20; G07D 7/202; G07D 7/205; G07D 7/206; G07D 7/2008; G07D 7/2033; G07D 11/00; G07D 11/12; G07D 11/125; G07D 11/14; G07D 11/16; G07D 11/165; G07D 11/17; G07D 11/175; G07D 11/18; G07D 11/20; G07D 11/25; G07D 11/30; G07D 11/32; G07D 11/36; G07D 11/50; G07D 11/60; G07D 11/245
See application file for complete search history.

(56) References Cited

U.S. PATENT DOCUMENTS

| | | | |
|---|---|---|---|
| 8,544,630 | B2 | 10/2013 | Schutzmann et al. |
| 8,910,869 | B2 | 12/2014 | Schutzmann et al. |
| 9,014,458 | B2 * | 4/2015 | Liang ..... G07D 7/04 382/135 |
| 9,202,327 | B2 | 12/2015 | Su et al. |
| 9,703,994 | B2 | 7/2017 | Paul et al. |
| 10,001,532 | B2 | 6/2018 | Ogomi et al. |
| 10,002,267 | B2 | 6/2018 | Schutzmann |
| 2007/0095630 | A1 | 5/2007 | Mennie et al. |
| 2008/0143328 | A1 | 6/2008 | Thierauf et al. |
| 2011/0233277 | A1 | 9/2011 | Schutzmann et al. |
| 2012/0160632 | A1 | 6/2012 | Schutzmann et al. |
| 2013/0082105 | A1 | 4/2013 | Schutzmann et al. |
| 2014/0205177 | A1 | 7/2014 | Liang et al. |
| 2014/0233829 | A1 | 8/2014 | Su et al. |
| 2014/0367469 | A1 | 12/2014 | Schutzmann |
| 2015/0287260 | A1 | 10/2015 | Toyoda et al. |
| 2016/0055358 | A1 | 2/2016 | Paul et al. |
| 2016/0292951 | A1 * | 10/2016 | Su ..... G06V 30/2253 |
| 2017/0052233 | A1 | 2/2017 | Ogomi et al. |

FOREIGN PATENT DOCUMENTS

| | | | |
|---|---|---|---|
| DE | 102008061507 | A1 | 6/2010 |
| DE | 102009039588 | A1 | 3/2011 |
| DE | 102010035469 | A1 | 3/2012 |
| DE | 102011120972 | A1 | 6/2013 |
| DE | 102013205891 | A1 | 10/2014 |
| EP | 0276814 | A2 | 8/1988 |
| EP | 1589494 | A1 | 10/2005 |
| EP | 1770657 | A2 | 4/2007 |
| GB | 2413179 | A1 | 10/2005 |
| JP | 2015174409 | A1 | 4/2017 |
| WO | 2011154088 | A1 | 12/2011 |
| WO | 2016034206 | A1 | 3/2016 |

OTHER PUBLICATIONS

International Search Report for Application No. PCT/EP2017/001445, dated Mar. 28, 2018.
German Search Report for DE Application No. 102016015559.0, dated Dec. 27, 2016.

* cited by examiner

METHOD AND APPARATUS FOR DETECTING A SECURITY THREAD IN A VALUE DOCUMENT

BACKGROUND

The present invention relates to a method for detecting a security thread in a value document and means for carrying out the method.

Value documents are understood as sheet-shaped objects, which represent, for example, a monetary value or an authorization and which should therefore not be manufacturable at will by unauthorized persons. They hence have features, so-called security features, that are not easy to manufacture, in particular to copy, whose presence is an indication of authenticity, i.e. manufacture by an authorized body. Some important examples of such value documents are chip cards, coupons, vouchers, checks and in particular banknotes.

Certain types of value documents frequently contain as a security feature a security thread that is at least partially embedded in the substrate of the value document. Since the security threads are frequently embedded in the substrate of value documents, value documents with security threads are thicker in the sections with the security threads, which could result in skewed stacks when stacked. The location of security threads in value documents, also of the same type, is therefore not precisely determined, but can vary within predetermined limits.

In many cases, the security threads have one or several magnetizable regions that can be magnetized by means of an external magnetic field. In the following, a security thread is understood as a security thread which can be magnetized as a whole or has one or several magnetizable regions. Such security threads or regions of security threads are detectable by means of suitable magnetic sensors. Examples of such sensors are described, for example, in DE 196 25 224 A1, DE 10 2008 061 507 A1, DE 10 2009 039 588 A1, DE 10 2010 035 469 A1, DE 10 2011 120 972 A1 and WO 2011/154088 A1. To increase security, the security threads can have a magnetic coding. The magnetic coding can be formed by sections of the security thread that have different magnetic properties in accordance with a predetermined pattern or code. The sections can differ in particular with respect to their magnetizability; for example, the sections can be magnetically soft or hard. Magnetically hard sections can additionally differ in their coercive field strength. A closer examination of such security threads with coding is greatly facilitated when the location of the security thread is known.

Magnetic sensors are employed for checking by machine. For detecting a security thread, i.e. at least its presence and/or its location, the measuring signals of a respective magnetic sensor have to be evaluated. However, this is complicated by the circumstance that the measuring signals can be subject to noise. Further, in the substrate of a value document small portions of magnetizable materials can be present, which have inadvertently entered the substrate material. Also, a print with a magnetizable printing ink can make recognition of the security thread more complicated.

SUMMARY

It is therefore the object of the present invention to state a method for detecting a security thread in a value document, which operates in robust and simple manner. It is a further object of the present invention to state means for carrying out the method.

The object is achieved by a method for detecting a security thread in a value document, in which magnetic data for sites on the value document are employed that represent a magnetic property of the value document at the site, check sites on the value document are determined employing these sites, and from the check sites a straight line is ascertained along which or on which at least some of the check sites lie and which represents a location of the security thread. Use is made here of the circumstance that security threads extend in a straight line in a value document. Preferably, the straight line is specified such that as many of the check sites as possible lie along or on the straight line.

It is preferred that for specifying the straight line a method section is carried out in which a pair of two of the check sites on the value document is selected and for a straight line through the check sites of the pair there are computed deviations of at least the other check sites from the straight line, and a set of those check sites is specified for which the deviation is smaller than a predetermined maximal deviation, the method section is repeated for other pairs until an abort criterion is fulfilled, wherein for each of the sets a suitability value is specified that describes how well the check sites of the set describe the location of a security thread, as the location of the security thread a straight line is ascertained that reproduces the location of the check sites of that one of the sets for which the highest suitability value was ascertained.

The object is further achieved by a method according to claim 2 and in particular a method for detecting a security thread in a value document, in which magnetic data for sites on the value document are employed, which data represent a magnetic property of the value document at the site, check sites on the value document are determined employing the sites, a method section is carried out in which a pair of two of the check sites on the value document is selected and for a straight line through the check sites of the pair there are computed deviations of at least the other check sites from the straight line, and a set of those check sites is specified for which the deviation is smaller than a predetermined maximal deviation, the method section is repeated for other pairs until an abort criterion is fulfilled, wherein for each of the sets a suitability value is specified that describes how well the check sites of the set describe the location of a security thread, as the location of the security thread a straight line is ascertained that reproduces the location of the check sites of that one of the sets for which the highest suitability value was ascertained.

The object is further achieved by an evaluation device for detecting a security thread in a value document which has an interface for capturing signals from which the magnetic data can be ascertained, or for capturing the magnetic data, and is adapted to carry out a method according to the invention.

The object is further achieved by a computer program for execution by means of a data processing device with a processor, which program contains program code upon whose execution a method according to the invention is executed by the processor.

The object is further achieved by a computer-readable data carrier on which a computer program according to the invention is stored.

The evaluation device according to the invention can in particular have a data processing device with at least one processor and a memory in which a computer program according to the invention for execution by the processor is stored.

Unless otherwise indicated by the context, the following general statements apply to both methods.

With the method according to the invention and the means according to the invention for carrying out the method, it is possible to easily determine the location of a security thread in a very robust manner, even if other magnetizable components and/or magnetic print are disposed in the region of the security thread.

In the method, magnetic data for sites on the value document are employed that represent a magnetic property of the value document at the site. As a rule, the magnetic data are captured for a small region of the value document, a measuring spot whose shape and size depend on the spatial resolution of a magnetic sensor employed to capture the magnetic data. The site is then understood as a site given by coordinates which, according to a predetermined rule, results from the shape and location of the measuring spot. For example, the geometric center of the measuring spot could be employed.

The magnetic data represent a magnetic property of the value document at the site. Depending on the type of value document, more precisely of the security thread, the magnetic property can be, for example, the magnetizability or the remanence. For the purposes of the method according to the invention it is sufficient here for a number to be ascertained for a site from signals of a magnetic sensor employed for capture, and to be employed as a magnetic data item which can have any desired units predetermined for the method and can be scaled as desired as predetermined for the method.

In the method, upon their employment, the magnetic data can be read from, for example, a memory in which they are stored and then employed further.

In a preferred variant of the method, magnetic data for sites can be captured by means of a magnetic sensor on the value document, i.e. in spatially resolved manner, and these magnetic data can be employed as magnetic data. In principle, any magnetic sensors come into consideration as magnetic sensors, for example inductive magnetic sensors, magneto-resistive magnetic sensors, GMR sensors or also Hall sensors.

The method does not necessarily employ all the magnetic data captured for a value document. Preferably, check sites are specified which lie only in a subregion of the value document. This subregion, in which the security thread is presumed, can be specified or predetermined in different ways. Thus, in the method, a value document type of the value document can be specified and the subregion can be predetermined in dependence on the particular value document type. In the case of value documents in the form of banknotes, the value document type can be given for example by the currency, the denomination or value and optionally the issue of the banknotes. Particularly preferably, a location of the value document is also ascertained and the subregion is additionally predetermined in dependence on the ascertained location. When the value document is disposed or moves in a plane when the magnetic data are captured, the location of the value document is understood as one of the four possible orientations of the value document in the plane, which, through rotations by 180° about axes through the centroid of the value document, extend parallel or perpendicularly to a longer edge of the value document. When predetermining the subregion, predetermined reference parameters can be employed, in particular for the value document type and possibly the location, which can be stored, for example, in the evaluation device.

However, it is also possible to specify the subregion on the basis of the magnetic data employing at least one predetermined criterion. The criterion can in particular be a criterion that the magnetic data are suitable for the detection of the security thread. Particularly preferably, the criterion can concern the magnetic property and/or the local location or distribution of the check sites and/or local changes, preferably a gradient, of the magnetic property in at least one predetermined direction. For example, the criterion can be that the subregion is a rectangle that extends across the value document and that contains sites whose magnetic data fulfill a predetermined data criterion.

In this manner, the number of measuring values employed subsequently can be significantly reduced and thus the implementation of the method can be accelerated. Moreover, it is possible to rule out measuring values which are unsuitable due to their location on the value document alone, and which would impair reliability and/or accuracy. In this manner, a more reliable and/or robust detection can be made possible. In addition, the method can be carried out faster.

In principle, the captured magnetic data can be employed in the method. However, it is preferred that for determining the check sites, the magnetic data in the predetermined subregion are filtered, thus forming filtered magnetic data, and the filtered magnetic data are employed to determine the check sites. In this manner, for example, sites where the magnetic data are falsified by noise or constitute mere noise can be avoided. Preferably, a filter is employed for filtering which has a smoothing effect and/or responds to gradients of the magnetic data. Smoothing can at least partially suppress fluctuations due to measurement inaccuracies. The filter responding to gradients highlights sites where the magnetic data change strongly, as expected on a security thread. The gradients can preferably be gradients in a direction transverse to the expected direction of a security thread to be detected.

The check sites can now be specified such that the magnetic data for these sites or the filtered magnetic data for these sites fulfill a predetermined criterion, for example a threshold value criterion. As a threshold value criterion, for example, the criterion can be employed that the magnetic data or the filtered magnetic data exceed a predetermined threshold value; this threshold value can be chosen such that magnetic data or filtered magnetic data corresponding to noise or other measurement inaccuracies are below the threshold value, but others are above it.

A further reduction of the number of check sites can be achieved if the security thread is only narrow and it is to be expected that only a small number of sites having magnetic data that are not caused by the security thread will occur in a direction transverse to the security thread. It is then preferred that in the method for parallel strips which extend transversely to a predetermined expected direction of the security thread, respectively one check site is determined in the strip for which the magnetic data or filtered magnetic data for sites in the strip fulfill a predetermined strip criterion. For example, as the strip criterion, the criterion can be employed that the magnetic data or filtered magnetic data for the check site are the maximum of the magnetic data or filtered magnetic data for all sites in the strip.

In the method according to the invention use is made of the circumstance that security threads typically extend in straight manner, i.e. along a section of a straight line. However, it is not to be expected that all check sites lie exactly on a straight line.

Therefore, in the method, the method section is carried out in which a pair of two of the check sites on the document is selected and for a straight line through the check sites of the pair there are computed deviations of at least the other check sites from the straight line, and a set of those check sites is specified for which the deviation is smaller than a predetermined maximal deviation. The check sites of the pair can preferably be selected randomly from the previously specified check sites.

For the other check sites then in each case a deviation of the respective check site from the straight line is computed. As the deviation the distance of the check site from the straight line can be ascertained, thus the length of the line segment between the check site and the straight line extending orthogonally to the straight line. However, also a monotonic function of the length can be employed as the deviation. When a predetermined coordinate representation is employed for the sites and/or check sites and/or the straight line, the straight line can be stated by the straight line stating a second one of the coordinates as a function of the first coordinate. As the deviation, then also the difference between the value of the function for the first coordinate of the check site and the second coordinate of the check site, for example the absolute value of the difference, or a monotonic function of this difference can be employed.

Then those of the check sites are specified for which the deviation is smaller than a predetermined threshold value, which was specified before, for example on the basis of measuring data for test value documents and/or in dependence on properties of the magnetic sensor captured for capturing the measuring data, as well as the rule for specifying the deviation. The threshold value is selected such that the check sites whose deviations are smaller than the threshold value are deemed representable by the straight line in good approximation. To the set in particular also those check sites can be added that served for determining the straight line.

This method section is repeated, wherein in each case a different pair of check sites is selected. Different pairs are understood to mean that at least one check site of the pair differs from at least one check site of a different pair.

In dependence on how the method is carried out, it is possible to store for one of the straight lines, i.e. for at least one of the method sections, the straight line specified in the method section, i.e. preferably parameters specifying the straight line and/or the set of those check sites specified in the method section for which the deviation is smaller than a predetermined maximal deviation and/or a different result of the method section in which for one of the straight lines the straight line and/or the set of those check sites, only if the number of check sites exceeds a predetermined minimum number. The predetermined minimum number can be selected, for example, in dependence on the number of measuring data or filtered measuring data available owing to the capture of the measuring data, or, for example, greater than 4.

The method section is repeated until a predetermined abort criterion is fulfilled. In particular, for this purpose it can be checked in each case after carrying out the method section whether or not the predetermined abort criterion is fulfilled. If it is fulfilled the method section is not carried out again.

The abort criterion can contain at least one of the following partial criteria. In a first embodiment, the abort criterion can be deemed fulfilled when at least one of the partial criteria is fulfilled, or in other embodiments when all partial criteria are fulfilled. One of the partial criteria can be the criterion whether the number of check sites of the set specified last exceeds a predetermined threshold value, preferably being dependent on the overall number of check sites ascertained, or is equal to the overall number of check sites ascertained. However, it is also possible to use the partial criterion that it is fulfilled when a predetermined number of method sections have been carried out. The predetermined number can be selected in dependence on the overall number of check sites ascertained or also on the execution time span for respectively one method section. A further partial criterion can be that it is fulfilled when the sum of deviations, optionally with reference to the number of check sites of the set, undershoots a predetermined threshold value. The latter can be selected, for example, in dependence on the accuracy of the measuring data and/or the spatial resolution of the measuring data and/or the type of the value document.

For each of the sets a suitability value is specified which describes how well the check sites of the respective set describe the location of a security thread. The specification of the suitability value can take place before the check of the abort criterion and can thus form part of the method sections. A partial criterion of the abort criterion can be that the suitability value is compared with a predetermined value and is set to be fulfilled in dependence on the comparison result; for example, it can be deemed fulfilled when, in dependence on the type of computation, the suitability value exceeds a predetermined value or undershoots a predetermined value.

The suitability value can in particular be computed in dependence on the number of check sites of the set absolutely or, in different embodiments, relatively to the overall number of check sites ascertained at the outset.

In a preferred embodiment, upon specifying the suitability value, the suitability value can be specified in dependence on the number of check sites of the set and, preferably, the number of check sites of the set can be employed as the suitability value. The number can be the number of check sites absolutely or, in different embodiments, relatively to the overall number of check sites ascertained at the outset.

Further, it can be preferred in the method to allocate weightings to the check sites of the respective set and, upon specifying the suitability value, to specify the suitability value in dependence on a sum of weightings. The weightings can preferably be formed such that they depend on magnetic data or filtered magnetic data for the check sites. Particularly preferably, weightings are allocated to all check sites. For example, the weightings can be specified such that their values are a predetermined monotonic, preferably motonically rising, function of the magnetic data or filtered magnetic data at the respective sites. In comparison to employing the number of check sites for a set, this can have the advantage that check sites with only small magnetic data or filtered magnetic data are not taken into account as strongly as other check sites. Particularly preferably, the suitability value can be given by the sum of weightings.

The straight line specified as the location of the security thread can be ascertained in every method section. It can then be stored as the preliminary location of the security thread together with the suitability value if no preliminary location has been stored before or if the suitability value is better than the suitability value stored last. However, it is also possible to store respectively the sets in the method sections. The suitability values can then be computed and stored respectively before executing the next method section. However, it is also possible to specify the suitability values only after executing the last method section.

When specifying the straight line that is specified as the location of the security thread, the straight line can in principle be specified by means of any desired suitable method. However, in the method it is preferred that when the straight line is specified as the location of the security thread, the straight line is computed by means of a compensating method. A compensating method is understood as a method in which a straight line is adjusted to the check site, so that the deviations between the check sites and the straight line are as small as possible. Such a method is also referred to as "fit" method within the meaning of the invention. When weightings are allocated to the check sites, these can be employed in the compensating method, preferably by weighting the deviations with the weightings. As the compensating method, in particular the method of linear regression can be employed.

As already explained, in one embodiment the straight line can be specified only when the last one of the method sections has been carried out. However, it is also possible that in the method for each of the sets of check sites of the set a straight line is ascertained by means of a compensating method, and said straight line is stored together with the suitability value only if the suitability value for the set is greater than the suitability value stored last.

The straight line specified as the location of the security thread and/or parameters representing such a straight line can be stored then and/or employed in a further method step. It is also possible to emit a signal representing the straight line specified as the location of the security thread and/or parameters representing such a straight line.

According to an advantageous development, a criterion for the presence of a security thread which depends on the best suitability value can be checked, for which purpose preferably the best suitability value is compared with a predetermined threshold value, and particularly preferably, in dependence on the result of the comparison, an indication of the presence of a security thread or an indication of the absence of a security thread is produced and/or stored and/or a signal is emitted that is indicative of the presence of a security thread or indicative of the absence of a security thread. Such an indication can be employed to assess the authenticity or a suspicion of forgery or forgery.

A further object of the invention is an apparatus for detecting a security thread in a value document, comprising a magnetic sensor for supplying the magnetic data and an evaluation device according to the invention, wherein preferably the magnetic sensor is connected to the interface of the evaluation device for transmitting magnetic data.

The apparatus can preferably further comprise a transport device for transporting the value document along a transport path, wherein the magnetic sensor is arranged on the transport path.

The invention can be used particularly well in an apparatus for processing value documents. Therefore the object of the invention is also an apparatus for processing value documents with a feeding device for feeding value documents to be processed, an output device for outputting or receiving the processed value documents, a transport device for transporting the value documents from the feeding device along a transport path to the output device and with at least one apparatus according to the invention arranged in the region of a section of the transport path for detecting a security thread in a value document being transported along the transport path. In particular, the magnetic sensor can be arranged on the transport path.

BRIEF DESCRIPTION OF THE DRAWINGS

The invention will hereinafter be explained further by way of example with reference to the drawings. There are shown.

DETAILED DESCRIPTION OF VARIOUS EMBODIMENTS

Figure 1:
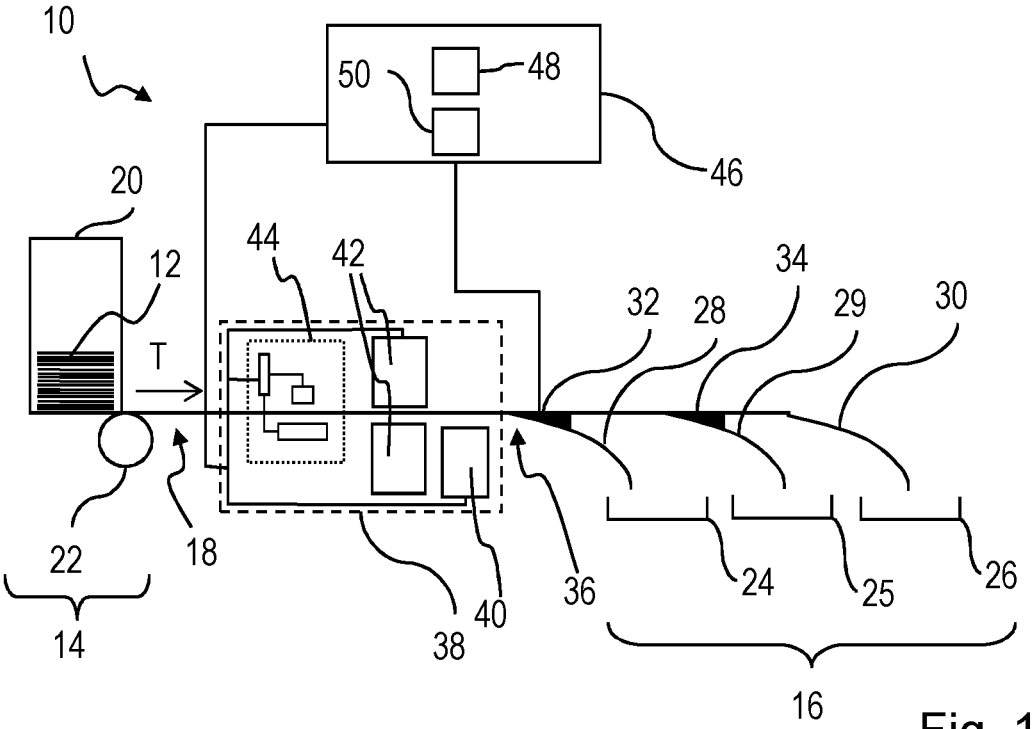
FIG. 1 a schematic representation of a value document processing apparatus, in the example of a banknote sorting apparatus, FIG. 2 a roughly schematic representation of a magnetic sensor of the value document processing apparatus in FIG. 1, FIG. 3 a schematic representation of a value document with a security thread and a field of sites on the value document for which magnetic data are captured, FIG. 4 a roughly schematic flowchart of an example of a method for detecting a security thread in a value document, FIG. 5 a filter employed in step S14, and FIG. 6 a roughly schematic flowchart of a further method for detecting a security thread in a value document.

A value document processing apparatus 10 in FIG. 1, in the example an apparatus for processing value documents 12 in the form of banknotes, is configured to sort value documents 12 in dependence on the state ascertained by the value document processing apparatus 10 and the authenticity of processed value documents checked by means of the value document processing apparatus 10.

It has a feeding device 14 for feeding value documents 12, an output device 16 for dispensing or receiving processed, i.e. sorted value documents, and a transport device 18 for transporting singled value documents from the feeding device 14 to the output device 16.

In the example, the feeding device 14 comprises an input pocket 20 for a value document stack and a singler 22 for singling value documents 12 from the value document stack in the input pocket 20 and supplying or feeding to the transport device 18.

In the example, the output device 16 comprises three output sections 24, 25 and 26 into which processed value documents can be sorted in dependence on the result of the processing, in the example checking. In the example, each of the portions comprises a stack pocket and a stacking wheel (not shown) by means of which fed value documents can be deposited in the stack pocket.

The transport device 18 has at least two, in the example three, branches 28, 29 and 30 at whose ends one of the output sections 24 or 25 or 26 is respectively arranged, and, at the branching points, gates 32 and 34 controllable by actuating signals, by means of which gates value documents can be fed to the branches 28 to 30 and thus to the output sections 24 to 26 in dependence on actuating signals.

On a transport path 36, defined by the transport device 18, between the feeding device 14, in the example more precisely the singler 22, and the first gate 32 after the singler 22 in the transport direction T, there is arranged a sensor device 38 which measures physical properties of the value documents when value documents are being transported past, and forms sensor signals reproducing the measurement results which represent sensor data. In this example, the sensor device 38 has three sensors, namely an optical remission sensor 40 which captures a remission color image of the value document, an optical transmission sensor 42 which captures a transmission image of the value document, and a magnetic sensor 44 which captures or measures in spatially resolved manner at least one magnetic property of the value document and forms corresponding sensor signals or sensor data which represent the magnetic property captured or measured for a respective site.

A control and evaluation device 46 is connected via signal lines to the sensor device 38 and the transport device 18, in particular the gates 32 and 34. In connection with the sensor device 38, it classifies a value document in dependence on the signals or sensor data of the sensor device 38 for the value document into one of predetermined sorting classes. These sorting classes can be predetermined, for example, in dependence on a state value ascertained by means of the sensor data and likewise in dependence on an authenticity value ascertained by means of the sensor data. For example, the values "fit for circulation" or "unfit for circulation" can be employed as state values; the values "forged", "suspected of forgery" or "authentic" can be employed as authenticity values. In dependence on the ascertained sorting class, it drives by emitting actuating signals the transport device 18, here more precisely the gates 32 or 34, such that the value document is output, in accordance with its sorting class ascertained upon the classification, into an output section of the output device 16, said section being allocated to the class. The allocation to one of the predetermined sorting classes or the classification takes place here in dependence on criteria predetermined for the assessment of the state and the assessment of the authenticity, which depend on at least a part of the sensor data.

The control and evaluation device 46 has for this purpose in particular, besides corresponding interfaces for the sensor device 38 or its sensors, a processor 48 and a memory 50 which is connected to the processor 48 and in which there is stored at least one computer program with program code upon whose execution the processor 48 controls the apparatus and evaluates the sensor signals of the sensor device 38, in particular for ascertaining a sorting class of a processed value document. Further, program code is stored upon whose execution the processor 48 controls the apparatus and drives the transport device 18 in accordance with the evaluation.

The control and evaluation device 46 ascertains from the sensor signals of the sensors of the sensor device 38 upon a sensor signal evaluation at least one value document property which is relevant for the checking of the banknotes with respect to their authenticity and/or state. Preferably several such value document properties are ascertained. In this example, as optical value document properties, a transmission image and a remission image and magnetic data which describe at least one magnetic property of the value document in dependence on the site on the value document are ascertained, and, on the basis thereof, the presence, the location and properties of a security thread are ascertained.

In dependence on the value document properties, the control and evaluation device 46 respectively ascertains, while employing the sensor data of the various sensors in partial evaluations, whether or not the ascertained value document properties represent an indication of the state or the authenticity of the value document. Following this, corresponding data can be stored in the control and evaluation device 46, for example the memory 50, for later employment. In dependence on the partial evaluations, the control and evaluation device 46 then ascertains a sorting class as the overall result for the check according to a predetermined overall criterion, and forms the sorting or actuating signal for the transport device 18 in dependence on the ascertained sorting class.

For processing value documents 12, value documents 12 inserted into the input pocket 20 as a stack or singly are singled by the singler 22 and fed in singled form to the transport device 18, which transports the singled value documents 12 past the sensor device 38. The latter captures the properties of the value documents 12, wherein sensor signals are formed which reproduce the properties of the respective value document. The control and evaluation device 46 captures the sensor signals or sensor data, ascertains in dependence thereon a sorting class, in the example a combination of an authenticity class and a state class, of the respective value document, and so drives the gates in dependence on the result that the value documents are transported in accordance with the ascertained sorting class into an output section allocated to the respective sorting class.

Among other things, an apparatus 52 for detecting a security thread in a value document, in this example the magnetic sensor 44, a corresponding section of the control and evaluation device 46, in particular corresponding instructions of the computer program therein, serves to ascertain a sorting class in dependence on the magnetic properties of the value document.

Figure 2:
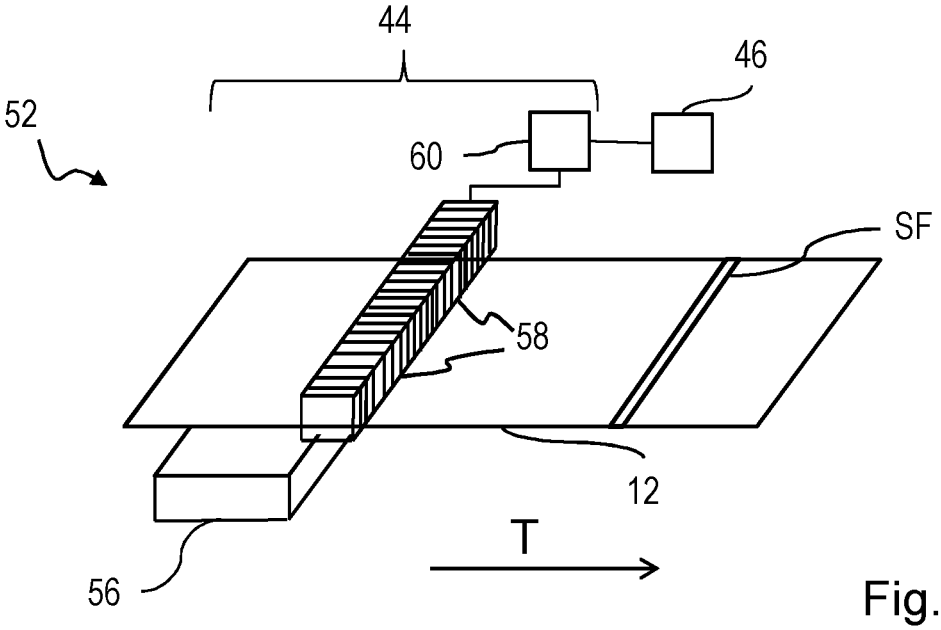

The magnetic sensor 44 is shown roughly schematically in FIG. 2. It comprises a device 56 for producing a magnetic field and magnetic-field sensitive sensor elements 58, which are configured identically and arranged along a line transversely to the transport direction T and are configured to capture a magnetic field and form corresponding element signals. A signal processing unit 60, which is connected to the control and evaluation device 44, serves to process the element signals of the sensor elements 58 and form the sensor signals or sensor data of the magnetic sensor 44. The device 56 for producing a magnetic field can comprise at least one permanent magnet and/or one electromagnet. In the example, the sensor elements 58 are magneto-resistive sensor elements, in other embodiments these could also comprise inductively operating sensor elements and/or Hall sensors and/or GMR sensors.

The magnetic sensor 44 captures magnetic data for sites on the value document at predetermined time intervals, said sites lying in a line transversely to the transport direction in accordance with the arrangement of the sensor elements 58, and transmits these data to the control and evaluation device 46. The magnetic data for a site are transmitted and stored such that magnetic data and sites are allocated to each other. In the example, the magnetic data are stored in dependence on a coordinate along a direction parallel to the transport direction and a coordinate perpendicular to the direction parallel to the transport direction. While the sites and thus their coordinates are given transversely to the transport direction by the magnetic sensor elements of the magnetic sensor, the coordinates in the transport direction result from of the transport speed, which is predetermined by the transport device, and the capture times or the length of the time intervals. For the same coordinates transverse to the transport direction, there result, at successive points in time and thus in sites arranged in strips along the transport direction and correspondingly spaced, magnetic data allocated thereto. The control and evaluation device 46 stores the magnetic data received for the value document in dependence on the site. After the value document has passed the magnetic sensor 44, therefore, at constant transport speed, magnetic data are thus present for sites on a rectangular grid, whose grid spacing, in the transport direction, depends on the transport speed and the time intervals and, perpendicular to the transport device, on the spacing of the magnetically sensitive elements.

Figure 3:
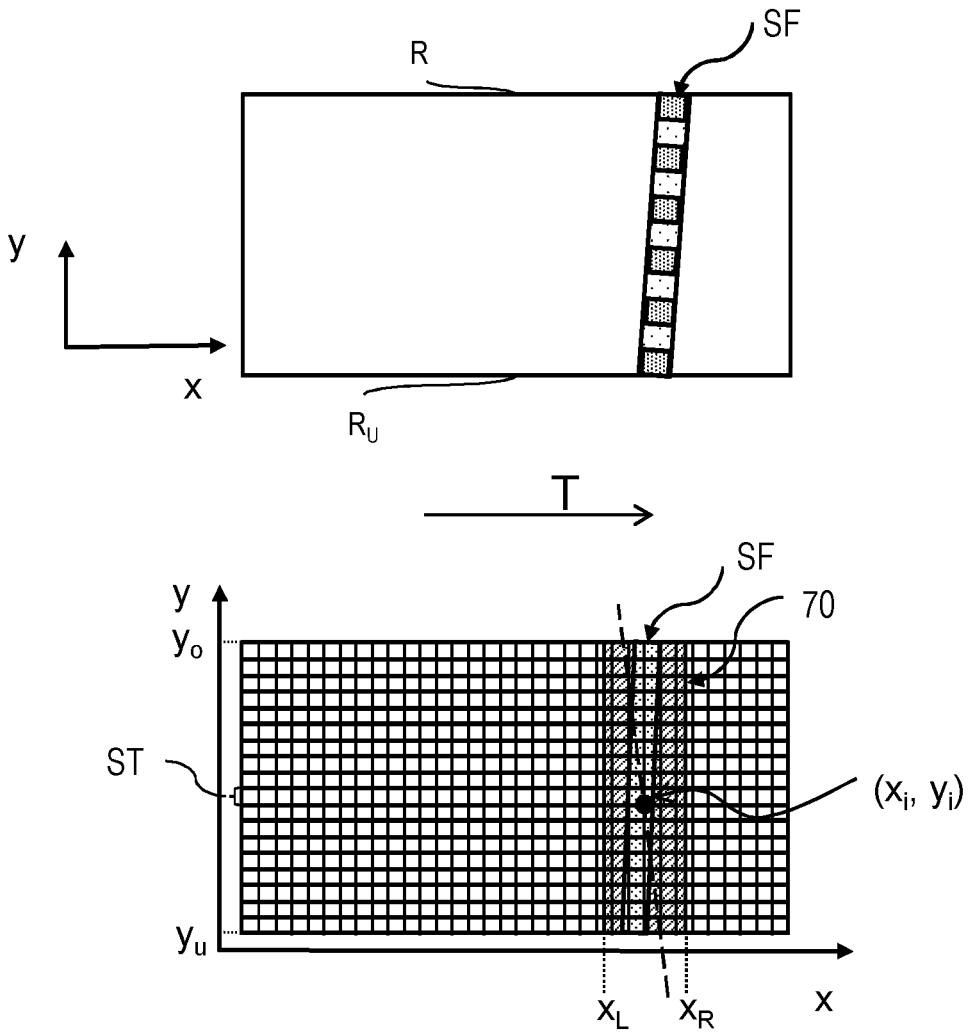

FIG. 3 shows at the top a value document with a security thread SF and below the corresponding field of sites where magnetic data have been captured. The captured magnetic data are allocated to sites ($x^{(i)}$, $y^{(i)}$) on the value document, which in the example lie on a rectangular grid. x designates a coordinate in the longitudinal direction and thus in this example in the transport direction T of the value document, y designates a coordinate perpendicular thereto. With the index i (i=1, . . . , N, N number of sites) the sites are differentiated or counted. For the sake of clarity, only a few sites are shown in FIG. 3; in fact the number can be substantially greater.

Since in this example it is assumed that the value documents each have a security thread SF which is arranged in an expected direction parallel or at least approximately parallel to the short side or transversely or orthogonally to the direction of the longer side of the value document (cf. FIGS. 2 and 3), and that the value documents are transported with their longitudinal side at least approximately parallel to the transport direction T, the expected direction of the security thread extends in the direction of the y axis and transversely to the transport direction T.

In the example in FIG. 3, to illustrate the general case, the security thread is shown inclined with respect to the direction to be actually expected relative to the longitudinal edge or transport direction, which can be caused, for example, by irregularities in transport. Ideally, it would extend in the expected or expectable direction perpendicular to the transport direction.

Figure 4:
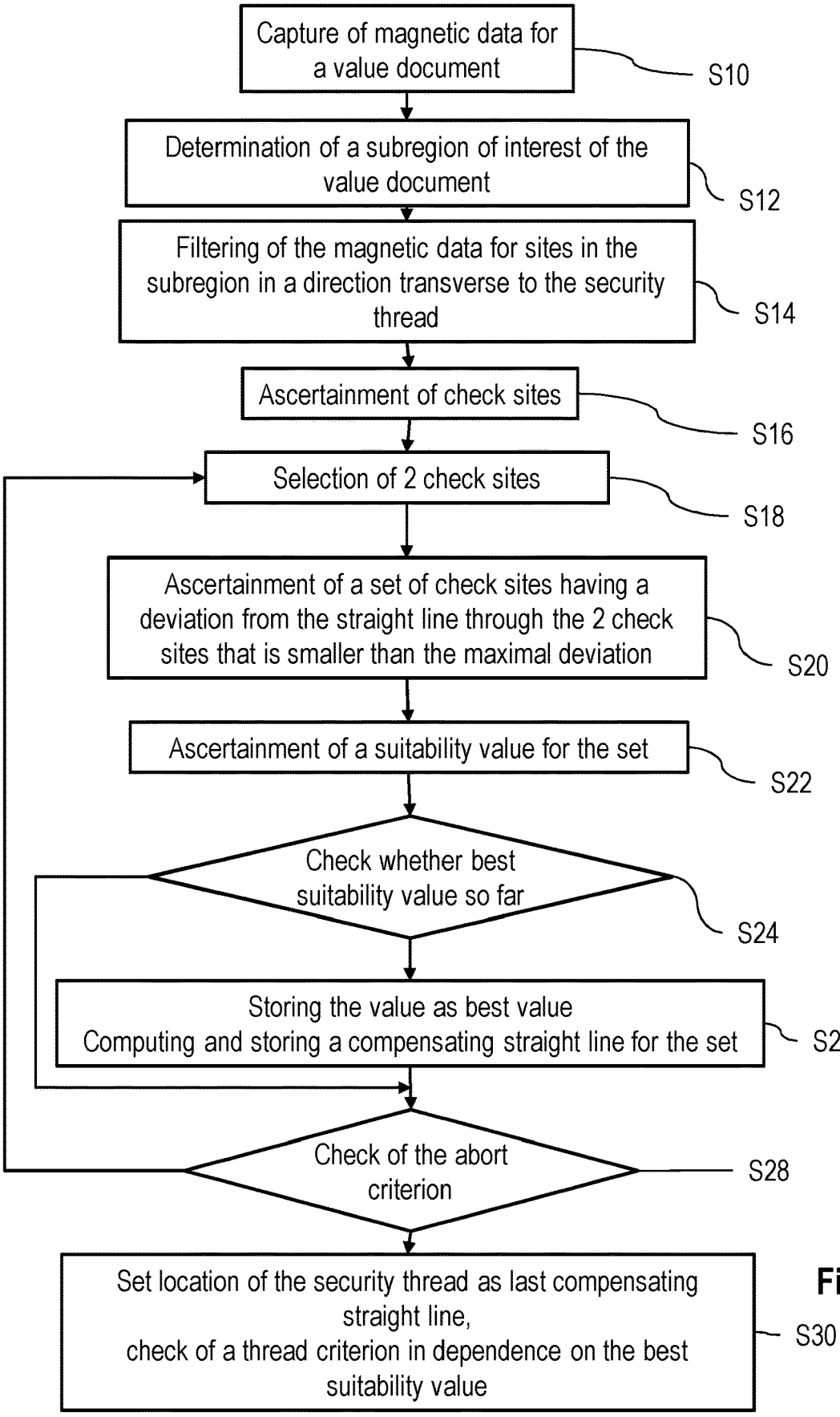

The control and evaluation device 46 comprises a data processing device. In the memory 50 of the control and evaluation device 46 or the apparatus 52 a computer program with program code is stored upon whose execution by the processor 48 of the control and evaluation device 46 the following method for detecting the security thread in the value document is carried out. The method is illustrated roughly schematically in FIG. 4.

In step S10, the magnetic sensor 44 captures magnetic data at predetermined time intervals while a value document is transported past.

These magnetic data are stored in the memory 50 in a manner allocated to the sites and thus supplied for the method. In this example, they can be stored in matrix form, wherein x and y coordinates are replaced by corresponding line and column indices.

In steps S12 to S16, check sites are determined, which are employed in the following steps, i.e. from step S18.

In the optional step S12, employing the magnetic data, a subregion of interest of the value document is determined, in which the security thread is to be expected. For this purpose, in the present example, average values are formed over magnetic data at sites in columns extending respectively in the y direction. The sites of the columns each have the same x coordinate, but different y coordinates. These average values are filtered with a filter which smoothes and at the same time ascertains gradients, for which purpose a Haar wavelet filter, for example, can be employed. The x coordinate of the maximal filter response then gives an indication of the approximate location of the security thread in the x direction. As a subregion, a rectangle can then be ascertained which is limited in the y direction by the opposing edges $R_U$ and $R_O$ of the value document and in the x direction by two straight lines in the y direction. In the example, the x coordinates of the straight lines in the y direction limit an interval of a predetermined length, in whose middle the ascertained x coordinate of the maximum filter response lies. The length can be determined in a predetermined manner in dependence on a maximal extension of value documents to be processed in the y direction and a maximal inclination of the security thread to be expected in the captured data with respect to the y axis. Such a subregion 70 is represented in FIG. 3 as a hatched rectangle in which the security thread SF lies. It extends between the two edges $R_U$ and $R_O$ of the value document extending parallel to the transport direction T, with y coordinates $y_u$ and $y_o$, and is limited in the transport direction by two straight lines perpendicular to the transport direction which intersect the x axis at the coordinates $x_L$ and $x_R$.

In the following, only sites in this subregion will be considered or employed further.

In step S14, which is likewise optional, in order to determine the check sites, the magnetic data for sites in the subregion in a direction transverse to the security thread are filtered, thus forming filtered magnetic data. This is done to highlight contributions that come from the security thread. The filter employed is a filter which responds to gradients of the magnetic data in a direction transverse to the expected direction of the security thread, thus in this case in the x direction. In this example, it is intended to additionally have a smoothing effect.

Figure 5:
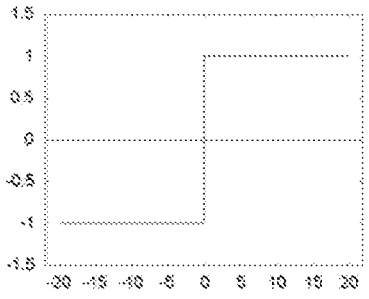

In the present example, a Haar wavelet is employed for this purpose, which is schematically illustrated in FIG. 5 and whose rectangles have a width in dependence on the spatial resolution of the magnetic data, for example 20 pixels in the x direction. In the representation, a representation of the magnetic data in matrix form is assumed.

In the following step S16, check sites are determined in the subregion employing the filtered magnetic data. For this purpose, it is assumed in the example that the security thread SF does not extend parallel to the transport direction T or the x axis, but approximately in an expected direction perpendicular to the transport direction T. Parallel strips ST, which extend transversely to a predetermined expected direction of the security thread SF or in the transport direction, are considered. In the example, the strips extend parallel to the x axis, wherein their width corresponds to the spacing of the sites in they direction. The sites of a strip then lie on a straight line parallel to the x axis. For a respective strip, sites in the strip are searched which fulfill a predetermined strip criterion for the filtered magnetic data. In the example said criterion is that the maximum of the filtered magnetic data of sites of the strip lies at the site. Thus, for a strip, that site is searched at which the maximum of the filtered magnetic data of sites of the strip lies. If the maximum exceeds a predetermined minimum value, which is above the threshold for noise in the magnetic data, the site is determined as check site.

In the steps S18 to S26 a method section is carried out that is repeated until an abort criterion is fulfilled. For a straight line through two of the check sites on the value document deviations of at least the other check sites from the straight line are computed. Then a set of those check sites for which the deviation is smaller than a predetermined maximal deviation:

In step S18, first two check sites are selected from the check sites; in the example these are selected randomly.

In step S20 first a straight line extending through the check sites is specified from the coordinates of the two check sites. The straight line is given by two straight line parameters which are computed in a manner known per se when the straight line is specified. Then a set of the check sites is specified whose deviation from the straight line is smaller than a predetermined maximal deviation. The maximal deviation d is selected in dependence on the rule for ascertaining the deviation employing test value documents. In the present example the deviation $\Delta_i$ of a check site i with the coordinates $(x_i, y_i)$ from the straight line with the straight line parameters inclination a and axis section b is computed as $$\Delta_i=(y_i-(a\cdot x_i+b))^2.$$

The check sites are stored or marked as forming part of the set at least for the duration of the method step.

Then in step S22 the suitability value of a suitability function G is ascertained, which describes how well the check sites thus specified in step S20 describe the location of a security thread.

In the present example, the number of check sites is employed as the suitability function G, so that the suitability value is the number of check sites of the set.

In step S24 it is checked whether the suitability value ascertained for the current set is the greatest suitability value so far. If this is not the case, the method is continued with step S28. If the current suitability value is the best or greatest suitability value so far, the method is continued with step S26. In the first execution of the method section, no suitability value is present yet; the current suitability value is deemed the greatest suitability value so far.

In step S26 the current suitability value is stored as the best suitability value so far. Further, by means of a compensating method, in the example linear regression, a compensating straight line is ascertained for the check sites of the set. Said line then extends through the check sites as well as possible. Said compensating straight line or the parameters thereof are stored as preliminary best location of the security thread.

In step S28 an abort criterion is checked for whether or not a further method section is to be carried out. As the abort criterion it is checked here whether a predetermined number of method sections has already been carried out, i.e. whether a predetermined number of sets has been specified. This number can be selected in dependence on the number of sites in the subregion and/or the available computing time and/or empirical values for test banknotes of the given type, and is preferably greater than 5.

If the abort criterion is not fulfilled, the method is continued with a next method section, more exactly step S18.

Otherwise, in step S30 the compensating straight line and/or the parameters thereof stored last, which were stored as the preliminarily best location of the security thread, are set as the location of the security thread.

In addition, in this step a thread criterion is checked for the presence of a security thread, with said criterion depending on the best suitability value. For this purpose, in the example the best suitability value is compared with a predetermined threshold value. In the present example, said threshold value reproduces the minimum number of check sites starting from which a sufficient number of check sites are deemed representable by a straight line. The threshold value can depend on the number of sites with magnetic data transverse to the transport direction and results for test banknotes. In dependence on the result of the comparison, an indication of the presence of a security thread or an indication of the absence of a security thread is produced and stored and a signal is emitted that is indicative of the presence of a security thread or indicative of the absence of a security thread. If the suitability value undershoots the threshold value, a suspicion of forgery is determined and a corresponding signal is produced and/or corresponding data are stored. This signal can be employed together with other evaluation results to ascertain an authenticity of the value document or a corresponding sorting class and to emit a corresponding actuating signal. Otherwise, a method for checking the security thread is used for checking the same employing the ascertained location.

In other embodiment examples, it can additionally be checked whether the ascertained location of the security thread lies in a range permissible for the value document type. If this is the case, a corresponding authenticity signal is emitted which represents an indication of the authenticity of the document and/or a corresponding signal is emitted. These can then be employed to ascertain the authenticity of the value document together with other evaluation results of the other sensors.

For example in the case of coded threads, this can be followed in a further step by a check of the security thread itself, in the example a check of the coding of the security thread, in which the ascertained straight line or the ascertained parameters are employed. Such a check is described, for example, in DE 10 2013 205 891 A1, whose contents describing the method are hereby incorporated by reference into the description. Depending on the result of the check, a further authenticity signal can be emitted which indicates whether there is an indication of forgery or not.

Figure 6:
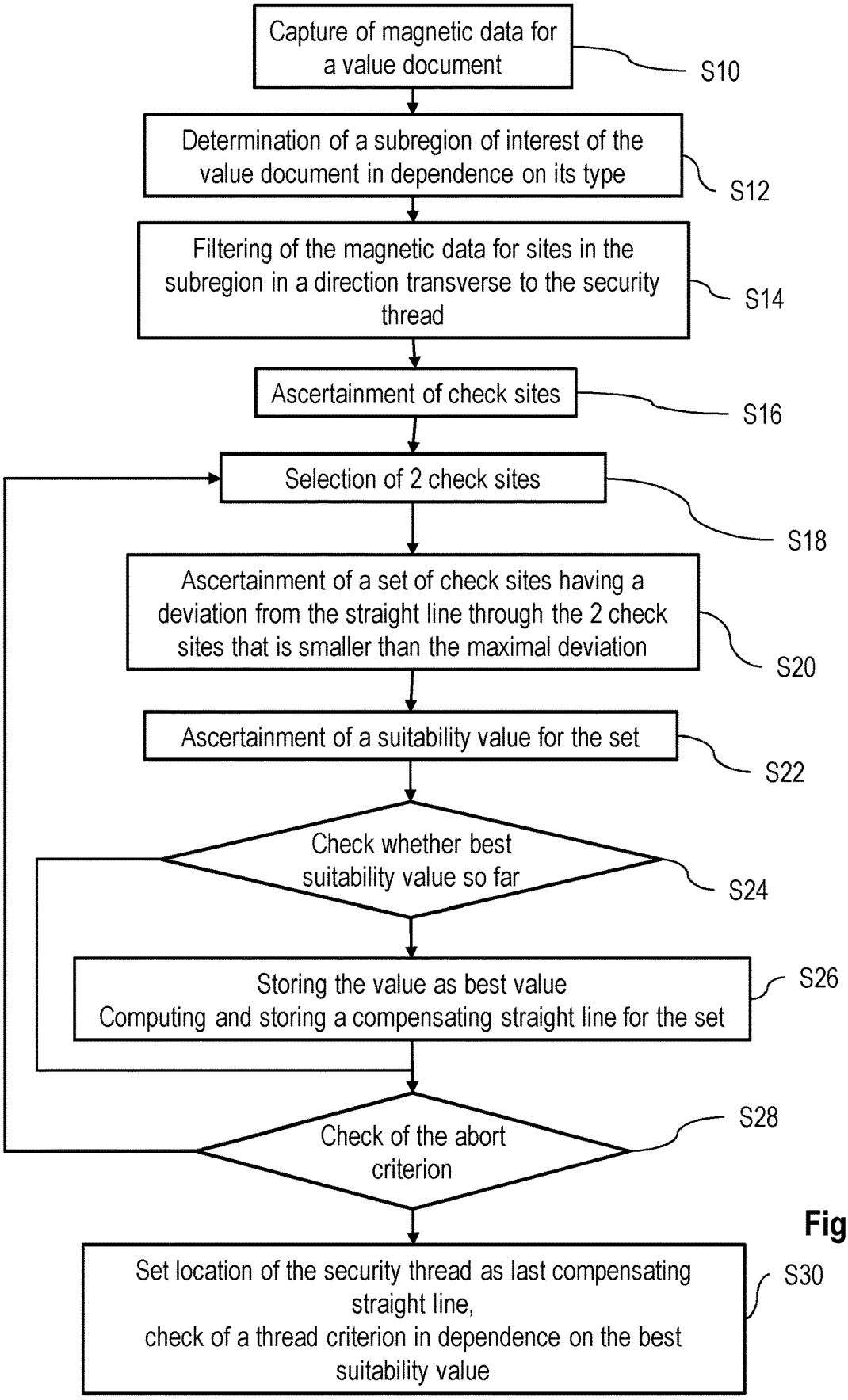

A further embodiment example in FIG. 6 differs from the first embodiment example in that the step S12 is replaced by a step S12'. In this step S12', for determining a subregion of interest of the value document, the substep first takes place of ascertaining the value document type, in the example the currency, the denomination and the issue of the value document, and the location of the value document in the transport path, for example in dependence on a digital image of the value document, which was captured by means of at least one optical sensor, in the example by the optical remission sensor 40 and/or the transmission sensor 42. Further, corresponding reference data stored in the control and evaluation device 46 are employed, which describe a subregion of interest of the value document for a given value document type and a given location. These data, which are specified in dependence on the value document type ascertained and the location ascertained, determine the subregion of the value document to be employed in the following.

The further steps of the method are unchanged with respect to the first embodiment example.

Further embodiment examples differ from the described embodiment examples in that, instead of the Haar wavelet, a first derivative of the Gaussian bell curve or the magnetic signal itself is employed as the filter in step S14.

Other embodiment examples differ from the described embodiment examples in that step S16 does not employ the filtered magnetic data for ascertaining check sites, but for each of the strips that site is chosen as the check site where the magnetic data of the respective strip are maximal.

Further embodiment examples differ from the explained embodiment examples in that the steps S18 to S30 are changed such that the respective set of check sites is stored independently of the suitability value for the set, and the ascertainment of the suitability value, in particular of the set with the greatest suitability value and the compensating straight line take place only after the abort criterion has been fulfilled.

Further embodiment examples differ from the explained embodiment examples in that to the check sites weightings are allocated that depend on the magnetic data or filtered magnetic data for the respective check site. For example, the value of the magnetic data or filtered magnetic data could be employed. These can be ascertained in a modified step S16', for example, which does not differ from step S16 otherwise. Instead of the step S22 now a step S22' is carried out which differs from the step S22 only by the suitability function or the ascertainment of the suitability value. The suitability function for a set then is the sum of weightings of the check sites; the suitability value is accordingly the sum of weightings of the check sites. The following steps are unchanged, except for the selection of the threshold value in step S30.

Still further embodiment examples can differ from the explained embodiment examples in that step S28 is replaced by a step S28', which differs from step S28 only by the abort criterion. Said criterion is changed such that it is deemed fulfilled also if the suitability value overshoots a predetermined threshold value that can be selected analogously to the threshold value in step S30.

Further embodiment examples differ from the described embodiment examples in that the control and evaluation apparatus 46 comprises separate units which each have a processor and a memory in which corresponding program code is stored, and one of which has an interface for the sensor device and is configured to evaluate the sensor data of at least the magnetic sensor and to emit a sorting signal, and a different one is configured to control the apparatus in dependence on the sorting signal.

Still further exemplary embodiments can differ from the above-mentioned embodiment examples in that the step S20 is replaced by a step S20". Said step differs from step S20 only in that as the deviation now the square value of the distance of the check site from the straight line is employed. This distance, i.e. the geometrical distance of the check site from the straight line, is the length of the line section that extends orthogonally to the straight line between the check site and the straight line.

The invention claimed is:

1. A method for detecting a security thread in a value document, in which magnetic data for sites on the value document are employed which data represent a magnetic property of the value document at the sites, check sites on the value document are determined employing the sites, a method section is carried out, in which a pair of two of the check sites on the value document is selected and, for a straight line through the check sites of the pair, deviations are computed from the straight line, and a set of check sites is specified for which the deviation of the set of check sites is smaller than a predetermined maximal deviation, the method section is repeated for other pairs until an abort criterion is fulfilled, wherein for each set of check sites a suitability value is specified that describes how well the set of check sites describe a location of the security thread, as the location of the security thread a straight line is ascertained that reproduces the location of the set of check sites for which the highest suitability value was ascertained.

2. The method according to claim 1, wherein by means of a magnetic sensor, magnetic data are captured for sites on the value document and the magnetic data are employed as magnetic data.

3. The method according to claim 1, wherein check sites are determined that lie in a subregion of the value document.

4. The method according to claim 3, wherein a value document type of the value document is specified, and the subregion is predetermined in dependence on the value document type of the value document and its location.

5. The method according to claim 3, wherein the subregion is specified from the magnetic data.

6. The method according to claim 1, wherein, for determining the check sites, the magnetic data are filtered, thus forming filtered magnetic data, and the filtered magnetic data are employed to determine the check sites, wherein a filter is employed for filtering that has a smoothing effect and/or responds to gradients of the magnetic data.

7. The method according to claim 1, wherein, when determining check sites for parallel strips that extend transversely to a predetermined expected direction of the security thread, respectively, such a site is determined as the check site for which the magnetic data or filtered magnetic data fulfill a predetermined strip criterion.

8. The method according to claim 1, wherein the straight line and/or the set of check sites for which the deviation is smaller than the predetermined maximal deviation are stored only if the number of check sites exceeds a predetermined minimum number.

9. The method according to according to claim 1, wherein the abort criterion is selected such that it is fulfilled if the number of the set of check sites exceeds a threshold value and/or the abort criterion is selected such that it is fulfilled if a predetermined number of method sections has been carried out.

10. The method according to claim 1, wherein, upon specifying the suitability value, the suitability value is specified in dependence on a number of the set of check sites and as the suitability value the number of the set of check sites is employed.

11. The method according to claim 1, wherein weightings are allocated to the check sites of the, and, upon specifying the suitability value, the suitability value is specified in dependence on a sum of the weightings.

12. The method according to claim 1, wherein, upon specifying the straight line as the location of the security thread, the straight line is computed by means of a compensating method.

13. The method according to claim 1, wherein for each set of check sites, the straight line is ascertained from the set of check sites by means of a compensating method, and said straight line is stored together with the suitability value only if the suitability value for the set of check sites is greater than a suitability value which was stored last.

14. The method according to claim 1, wherein a criterion is checked for a presence of the security thread that depends on a best suitability value, for which purpose the best suitability value is compared with a predetermined threshold value, and particularly, in dependence on a result of a comparison, an indication of the presence of the security thread or an indication of the absence of the security thread is produced and/or stored and/or a signal is emitted that is indicative of the presence of the security thread or indicative of the absence of the security thread.

15. A computer program for execution by means of a data processing device with a processor containing program code, upon execution the processor executes a method according to claim 1.

16. A computer-readable data carrier on which the computer program according to claim 15 is stored.

17. An evaluation device for detecting the security thread in the value document, having an interface for capturing signals from which the magnetic data are ascertained, or for capturing the magnetic data, and being adapted to carry out the method according to claim 1.

18. The evaluation device according to claim 17, further having a processor and a memory in which a computer program is stored for execution by the processor, by means of which the method is carried out.

19. An apparatus for detecting the security thread in the value document, comprising a magnetic sensor for supplying the magnetic data and the evaluation device according to claim 17, wherein the magnetic sensor is connected to the interface of the evaluation device for transmitting magnetic data.

20. The apparatus according to claim 19, further comprising a transport device for transporting the value document along a transport path, wherein the magnetic sensor is arranged on the transport path.

21. An apparatus for processing value documents, with a feeding device for feeding value documents to be processed, an output device for outputting or receiving the processed value documents, a transport device for transporting the value documents from the feeding device along a transport path to the output device and with at least one apparatus arranged in a region of a section of the transport path for detecting the security thread in the value document being transported along the transport path, according to claim 19.

* * * * *